United States Patent [19]

Assmann

[11] Patent Number: 4,817,532

[45] Date of Patent: Apr. 4, 1989

[54] FRAGMENTATION SHELL FOR GRENADES, PARTICULARLY HAND GRENADES

[75] Inventor: Hans Assmann, Schwanenstadt, Austria

[73] Assignee: Oregon Etablissement fur Patentverwertung, Liechtenstein, Liechtenstein

[21] Appl. No.: 177,870

[22] Filed: Apr. 1, 1988

Related U.S. Application Data

[63] Continuation of Ser. No. 58,648, Jun. 2, 1987, abandoned, which is a continuation of Ser. No. 844,120, Mar. 26, 1986, abandoned.

[30] Foreign Application Priority Data

Apr. 1, 1985 [AT] Austria ..... 954/85

[51] Int. Cl.[4] ..... F42B 27/00; F42B 13/18

[52] U.S. Cl. ..... 102/482; 102/487; 102/496

[58] Field of Search ..... 102/482, 487, 491–497

[56] References Cited

U.S. PATENT DOCUMENTS

| | | | |
|---|---|---|---|
| 2,109,479 | 3/1938 | Gibbons | 102/482 |
| 2,564,751 | 8/1951 | Cook | 102/482 |
| 3,284,559 | 11/1966 | Assmann | 102/482 |
| 3,705,552 | 12/1972 | Lerman | 102/487 |
| 4,328,755 | 5/1982 | Frost | 102/496 |

FOREIGN PATENT DOCUMENTS

| | | | |
|---|---|---|---|
| 240735 | 6/1965 | Austria | 102/496 |
| 587310 | 11/1959 | Canada | 102/482 |
| 617519 | 4/1961 | Canada | 102/482 |
| 11880 | of 1907 | United Kingdom | 102/494 |
| 1749 | of 1909 | United Kingdom | 102/494 |

*Primary Examiner*—Harold J. Tudor

*Attorney, Agent, or Firm*—Lorusso & Loud

[57] ABSTRACT

Fragmentation shell for grenades, particularly hand-grenades, consisting of a hollow body, the wall of which is made of metal particles embedded in plastic and which has a form stretched out of the spherical, e.g. an egg-shaped. The wall of the fragmentation shell in the transition zone between bottom surface and side surface and/or between shoulder surface and side surface has an axially symmetrical thickening, with an increased density of metal particles compared with the adjacent wall zones of the fragmentation shell.

9 Claims, 1 Drawing Sheet

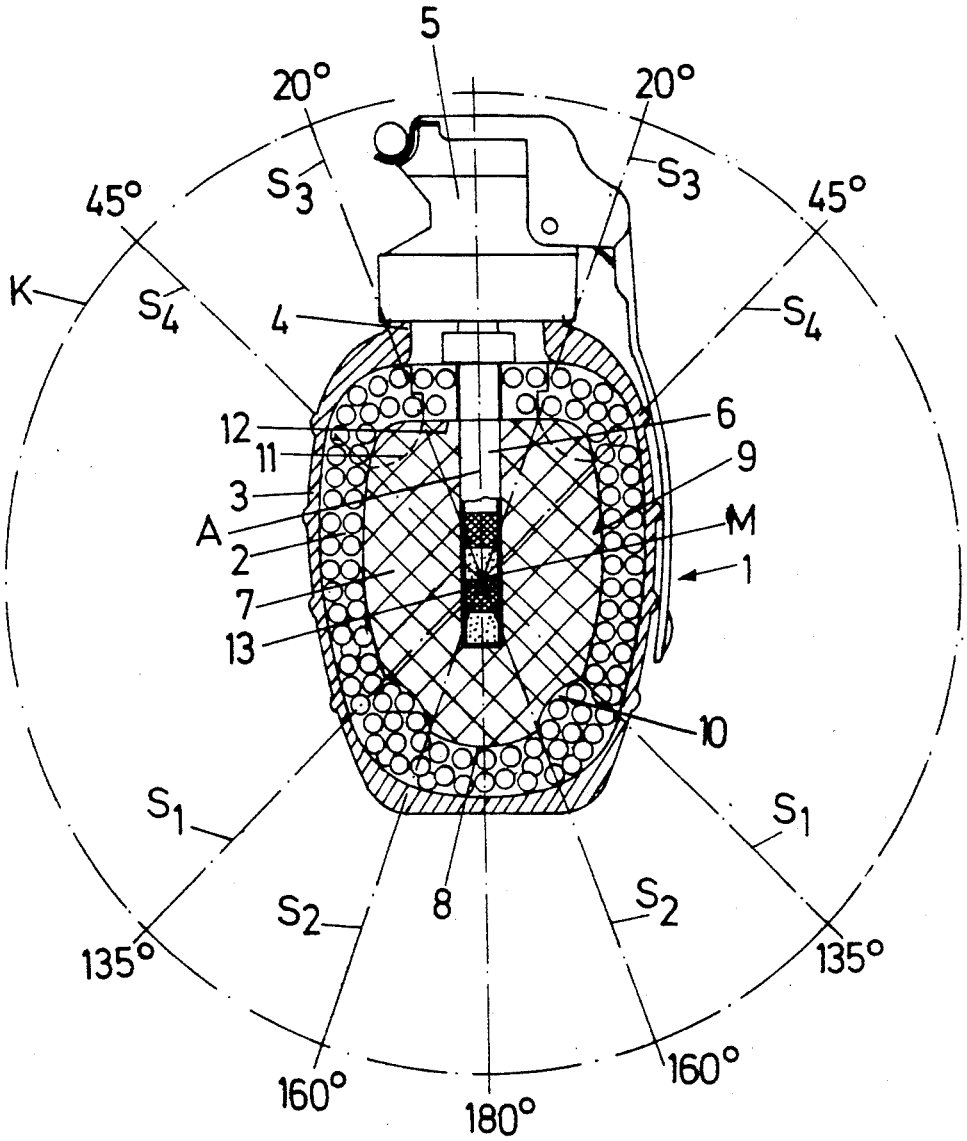
5
20°
20°
S3
S3
45°
45°
K
S4
S4
4
12
11
3
A
2
7
13
6
9
M
1
10
S1
S1
S2
S2
8
135°
135°
160°
160°
180°

FRAGMENTATION SHELL FOR GRENADES, PARTICULARLY HAND GRENADES

This is a continuation of co-pending application Ser. No. 058,648 filed on June 2, 1987, now abandoned, which is a continuation of U.S. Ser. No. 844,120 filed on Mar. 26, 1986 now abandoned.

The invention relates to a fragmentation shell for grenades, in particular hand-grenades, consisting of a hollow body, the wall of which consists of metal particles embedded in plastic and which has a shape stretched out of the spherical on the axis of which the fragmentation shell has at least one aperture.

With a grenade, in particular a hand-grenade, in order to achieve as uniform a splinter distribution as possible, the spherical form of fragmentation shell per se with a detonator in the centre of the sphere would be ideal. In such a case the detonation wave from the detonator in fact reaches all points on the inner spherical surface of the fragmentation shell in the same instant, so that the disintegration of the complete fragmentation jacket takes place simultaneously. Spherical fragmentation shells, however, cannot always be realised in practice, this on the one hand for ballistic reasons and on the other hand—particularly with hand grenades—for reasons of dimensioning. If in fact the required number of splinters and the required quantity of explosive results in a relatively large sphere as fragmentation shell, the ease with which such hand grenades can be used is impaired. Hand grenades for greater fragmentation and detonation efficiency are therefore generally given egg-shaped or otherwise extended-shape fragmentation shells, instead of spherical shells. With such hand-grenades, however, splinter distribution is irregular, i.e. it varies in different directions in relation to the three-dimensional axis system of the hand-grenade.

Fragmentation shells for hand-grenades are known which approximately in the centre zone or slightly above the centre of the side wall have an increased thickness towards the inside, by which the inner space of the hand-grenade is divided up into two compartments, a generally smaller upper compartment and a larger lower compartment. The object of this measure is the distribution of the detonation wave inside the hand-grenade to give a uniform scatter of splinters resp. metal particles. This effect has, however, not proved satisfactory in practice.

The objective of obtaining a fragmentation shell for a grenade, particularly a hand-grenade, which—although not of spherical shape—like a spherical fragmentation shell guarantees as uniform a splinter distribution as possible has therefore remained unsolved until now.

This objective is achieved according to the invention in that the wall of the fragmentation shell in the transitional zone between the base surface and the side surface, and/or between the shoulder surface and the side surface of the grenade, has an axially symmetrical increase in thickness with a greater concentration of metal particles compared with the adjacent wall zones of the fragmentation shell.

The base surface is the inside surface of the fragmentation shell opposite the aperture for the firing pin. The shoulder surface is the inside surface of the fragmentation shell surrounding the aperture for the firing pin.

It has been proven that by using the system according to the invention, in comparison with a hand-grenade with a fragmentation shell of egg-shape of known type, a more uniform distribution of effective splinters, i.e. a more uniform distribution of splinter penetrations through a test wall, is achieved, this test wall surrounding the hand-grenade to be tested at a set distance in a cylinder.

The increased thickness of the wall of the fragmentation shell according to the invention is advantageously made towards the inside of the hand-grenade, i.e. in the form of a bulge in the inner wall directed towards the inside, since a greater thickness on the outside would have an unfavourable effect on the outer shape of the hand-grenade.

It has been shown that a particularly favourable effect with respect to a uniformity of splinter penetration diagram is achieved if the bulge in the wall of the fragmentation shell, related to a spherical surface concentric to a centre point of the fragmentation shell, is located in the zone between sphere sectors 130° and 165°, preferably from 135° to 160°, where the zero degree axis coincides with the axis of the fragmentation shell and points towards the aperture in the fragmentation shell.

Important above all is an increased concentration of metal particles in the wall of the fragmentation shell in the transitional zone between the base surface and the side surface of the fragmentation shell precisely because in the splinter scatter sector corresponding to this zone a striking deficiency in splinter penetrations was observed. A similar splinter penetration lack can, however, also occur in the wall area of the fragmentation shell between shoulder zone and side surface. It is therefore advantageous if necessary to provide in the transition zone between shoulder surface and side surface of the fragmentation shell an increasing thickness containing a greater concentration of metal particles, i.e. related to a spherical surface concentric to a centre point of the fragmentation shell, in the zone between sphere sectors 15° and 50°, preferably 20° and 45°.

The feature according to the invention is particularly effective with a grenade resp. hand-grenade in which the detonator resp. the detonator centre is located at least approximately in the zone of the centre-point of the fragmentation shell, above all, however, in the case of a detonator which extends along the axis of the fragmentation shell and ends with a space above the bottom bulge resp (if a top bulge is also present) with a space below the top bulge of the fragmentation shell.

The invention is explained in more detail with reference to the drawing of an embodiment. The drawing shows a hand-grenade partially in vertical section.

The hand-grenade shown in the drawing has a hand-grenade shell (1), consisting of an inner fragmentation jacket (2) formed as a hollow body and an outer housing (3). The outer housing (3) is made of tough flexible plastic, e.g. Polyethylene and has a neck shaped attachment (4) with external thread. The wall of the fragmentation shell (2) consists of metal particles in the form of steel balls embedded in plastic. The metal particles are closely packed. The plastic holding the metal particles can be e.g. Polystyrol.

On the hand-grenade body, a firing head (5) is screwed comprising the conventional elements for functioning such as striker, safety handle, and firing tube (6). The firing tube (6) passes through the central aperture in the fragmentation shell (2) into the inside of the hand-grenade, i.e. into a recess in the bursting charge (4).

The wall of the fragmentation shell (2) has in the transitional zone between base surface (8) and the side surface (9) an axially symmetrical increased thickness (10) in the shape of a bulge facing inwards. In this increased thickness (10) there is a greater density of metal particles than in the adjacent wall areas of the fragmentation shell (2).

If necessary, in the transitional zone between the shoulder surface (12) and the side surface (9) of the fragmentation shell an axially symmetrical bulge (11) (indicated by broken line in the drawing) can also be present in the form of a bulge facing inwards.

The drawing also shows a spherical surface (K) concentric about a centre point (M) of the fragmentation shell.

The axis of spherical surface (K) coinciding with axis (A) of the fragmentation shell and pointing from centre point (M) towards the firing aperture is defined as the zero degree axis of the spherical surface (K). The increased thickness (10) of the wall of the fragmentation shell lies in the embodiment of the invention shown between sphere sectors S1 of 135° and S2 of 160°. The top bulge (11) of the wall of the fragmentation shell, if present, lies between sphere sector S3 of 20° and S4 of 45°. The centre point (M) of the fragmentation shell is the bisecting point of the axial extension (external dimension) of the fragmentation shell (2).

The detonator (13) which is fitted in the bottom part of the firing tube (6) and which consists e.g. of 4 part-charges, is arranged in such a way that its centre is located at the centre point (M) of the fragmentation shell. The detonator extending in direction of axis (A) of the fragmentation shell terminates at the bottom leaving a space above for the bulge (10) and at the top leaving a space below bulge (11) (if present).

The embodiment shown shows an essentially egg-shaped fragmentation shell. The feature according to the invention can, however, also advantageously be used with different "extended" forms of fragmentation shell, e.g. in the case of fragmentation shells having the form of an elipsoid, a cylinder, possibly with conical or semi-conical surfaces at top and bottom, and similar.

The invention is also not limited to hand-grenades, although it is of particular importance in this field of application.

I claim:

1. A fragmentation shell for grenades, in particular hand-grenades, comprising a hollow body defined by an inner fragmentation jacket, the inner fragmentation jacket being made of metal particles embedded in plastic and being enclosed by an outer housing to form said hollow body, said hollow body having a stretched spherical shape and at least one aperture along a central longitudinal axis, said inner fragmentation jacket having a side portion, a shoulder portion, a bottom portion and a transition zone, said transition zone being located where said side portion joins said bottom portion and extending over a sphere sector zone of an approximately 25° angle width and lying in the zone between sphere sector 130° and 165° related to a spherical surface concentric to a center point of said fragmentation shell, where the zero degree axis coincides with the central longitudinal axis of the inner fragmentation jacket that passes through the aperture in the inner fragmentation jacket, said transition zone having a thickness that is greater than any of the thicknesses along said side portion, said shoulder portion or said bottom portion, said increased thickness of said transition zone being designed to contain a greater accumulation of metal particles than any point along said side portion, said shoulder portion or said bottom portion to achieve a uniform distribution of fragments from an exploded grenade.

2. Fragmentation shell according to claim 1 wherein the transition zone of increased thickness in the inner fragmentation jacket has the form of a bulge facing inwards.

3. The fragmentation shell, according to claim 1 wherein said fragmentation shell is part of a grenade, particularly a hand-grenade, and said grenade comprises a detonator having a detonator center located at least approximately in the zone of the center point of the fragmentation shell.

4. A fragmentation shell for grenades, in particular hand-grenades, comprising a hollow body defined by an inner fragmentation jacket, the inner fragmentation jacket being made of metal particles embedded in plastic and being enclosed by an outer housing to form said hollow body, said hollow body having a stretched spherical shape and at least one aperture along a central longitudinal axis, said inner fragmentation jacket having a side portion, a shoulder portion, a bottom portion and a transition zone, said transition zone being located where said side portion joins said shoulder portion and extending over a sphere sector zone of an approximately 25° angle width and lying in the zone between sphere sector 15° and 50° related to a spherical surface concentric to a center point of said fragmentation shell, where the zero degree axis coincides with the central longitudinal axis of the inner fragmentation jacket that passes through the aperture in the inner fragmentation jacket, said transition zone having a thickness that is greater than any of the thicknesses along said side portion, said shoulder portion or said bottom portion of said inner fragmentation jacket, said increased thickness of said transition zone being designed to contain a greater accumulation of metal particles than any point along said side portion, said shoulder portion or said bottom portion to achieve a uniform distribution of fragments from an exploded grenade.

5. Fragmentation shell according to claim 4, wherein the transition zone of increased thickness in the inner fragmentation jacket has the form of a bulge facing inwards.

6. The fragmentation shell of claim 4 wherein said fragmentation shell is part of a grenade, particularly a hand-grenade, and said grenade comprises a detonator with the center of the detonator located at least approximately in the zone of the center point of the fragmentation shell.

7. A fragmentation shell for grenades, in particular hand-grenades, comprising a hollow body defined by an inner fragmentation jacket, the inner fragmentation jacket being made of metal particles embedded in plastic and being enclosed by an outer housing to form said hollow body, said hollow body having a stretched spherical shape and at least one aperture along a central longitudinal axis, said inner fragmentation jacket having a side portion, a shoulder portion, a bottom portion and two transition zones, said transition zones being located where said side portion joins said bottom portion and where said side portion joins said shoulder portion and extending over a sphere sector zone of an approximately 25° angle width and lying in zones between two sphere sectors related to a spherical surface concentric to a center point of said fragmentation shell, where the zero degree axis coincides with the central longitudinal axis of the inner fragmentation jacket that passes through the aperture in the inner fragmentation jacket, said transition zones each having a thickness that is greater than any of the thicknesses along said side portion, said shoulder portion or said bottom portion of said inner fragmentation jacket, said increased thickness of said transition zones being designed to contain a greater accumulation of metal particles than any point along said side portion, said shoulder portion or said bottom portion to achieve a uniform distribution of fragments from an exploded grenade.

8. Fragmentation shell according to claim 7 wherein the transition zone of increased thickness in the inner fragmentation jacket has the form of a bulge facing inwards.

9. The fragmentation shell of claim 7 wherein said fragmentation shell is part of a grenade, particularly a hand-grenade, and said grenade comprises a detonator with the center of the detonator located at least approximately in the zone of the center point of the fragmentation shell.

* * * * *